US005230505A

United States Patent [19]

Paquet et al.

[11] Patent Number: 5,230,505

[45] Date of Patent: Jul. 27, 1993

[54] APPARATUS FOR EVALUATING BALL PITCHING PERFORMANCE

[75] Inventors: Ghislain Paquet, Cap-Rouge; Jean Roy, Chateau-Richer, both of Canada

[73] Assignee: Moneywon Inc., Quebec, Canada

[21] Appl. No.: 790,224

[22] Filed: Nov. 8, 1991

[51] Int. Cl.[5] ..... A63B 69/40

[52] U.S. Cl. ..... 273/26 A; 273/371; 250/222.2; 250/206.2; 356/28

[58] Field of Search ..... 273/26 A, 26 R, 29 A, 273/371, 408, 181 H, 348, 378, 181 G, 176 FA; 250/222

[56] References Cited

U.S. PATENT DOCUMENTS

| | | | |
|---|---|---|---|
| 3,229,975 | 1/1966 | Tompkins et al. | 273/26 A |
| 4,180,726 | 12/1979 | De Crescent | 273/29 A |
| 4,304,406 | 12/1981 | Cromarty | 273/186 |
| 4,563,005 | 1/1986 | Hand | 273/26 R |
| 4,657,250 | 4/1987 | Newland et al. | 273/26 A |
| 4,770,527 | 9/1988 | Park | 273/26 A |
| 4,830,369 | 5/1989 | Poitras | 273/26 |
| 4,949,972 | 8/1990 | Goodwin et al. . | |
| 4,979,745 | 12/1990 | Kobayashi | 273/186 |

*Primary Examiner*—Theatrice Brown
*Attorney, Agent, or Firm*—McGlew and Tuttle

[57] ABSTRACT

There is disclosed an apparatus for monitoring and calculating the position and speed of a projectile as it is pitched over a target zone. A grid of infrared emitters aligned with respective infrared receivers are in continuous optical links until the ball passes an d cuts some of the links. Upon this cut, the position of the ball is stored in memory and the time of passage of the ball across the grid is recorded to later calculate the speed of the ball. The infrared grid is enclosed in a chamber to prevent interference of external light rays with the reception of the receivers.

10 Claims, 5 Drawing Sheets

APPARATUS FOR EVALUATING BALL PITCHING PERFORMANCE

BACKGROUND OF THE INVENTION

1. Field of the Invention

This invention relates generally to systems for detecting and calculating the coordinates of a projectile in a target zone, and in particular to an apparatus for evaluating the position and speed of a ball.

2. Description of the Prior Art

The main aim of a baseball pitcher is to throw the ball at a high speed across the plate within the strike zone but in areas where hits occur less frequently. As a strategy, the pitcher attempts to avoid hits by changing frequently the velocity, and the position of the ball as it penetrates the strike zone. There is a need, therefore, for a training apparatus that can be used by a baseball pitcher to improve his performance in pitch delivery and placement. Radar guns have been used to measure the velocity of a pitched baseball but its use has had only minimal impact on the training of baseball pitchers since it cannot evaluate the accuracy of the throw.

U.S. Pat. No. 4,563,005 discloses an apparatus for detecting and computing the location of a pitched baseball. However, this apparatus needs a sophisticated program to identify the position of the ball upon reception or non-reception on sequentially activated emitters. Also, a large number of emitters and detectors are required to evaluate the balls position with proper accuracy.

Furthermore, no provision is made to avoid interference of external light with the signal transmitted by the emitters.

OBJECTS OF THE INVENTION

It is therefore, an object of the present invention to provide a training device for monitoring the position and speed of a projectile as it passes through a strike zone that requires a minimum number of emitters and receivers.

It is another object of this invention to provide a training apparatus with improved detection over prior existing systems.

It is a further object of this invention to provide a simple method for calculating the speed of a projectile as it passes through the strike zone.

SUMMARY OF THE INVENTION

In accordance with the above-mentioned objects, the present invention consist of an apparatus for monitoring the position and speed of a projectile moving along a trajectory, the apparatus comprising:

a three dimensional monitoring system comprising a first array of infrared emitters aligned with infrared receivers for monitoring a first plane perpendicular to the trajectory, and a second array of infrared emitters perpendicular to the first array aligned with infrared receivers for monitoring a second plane perpendicular to the trajectory and distanced from the first plane, the first end second array of infrared emitters emitting perpendicular light beams that form a grid;

the receivers producing signals indicative of the position of the projectile in the grid; an interface unit for receiving the signals indicative of the position of the projectile from the receivers and generating corresponding derived signals;

processing means receiving the derived signal from the interface unit for determining and recording the position of the projectile and for determining the speed thereof as a function of times of entry and times of exit of the projectile from the grid; and output means for indicating the position and the speed of the projectile.

DETAILED DESCRIPTION OF A PREFERRED EMBODIMENT

Figure 1:
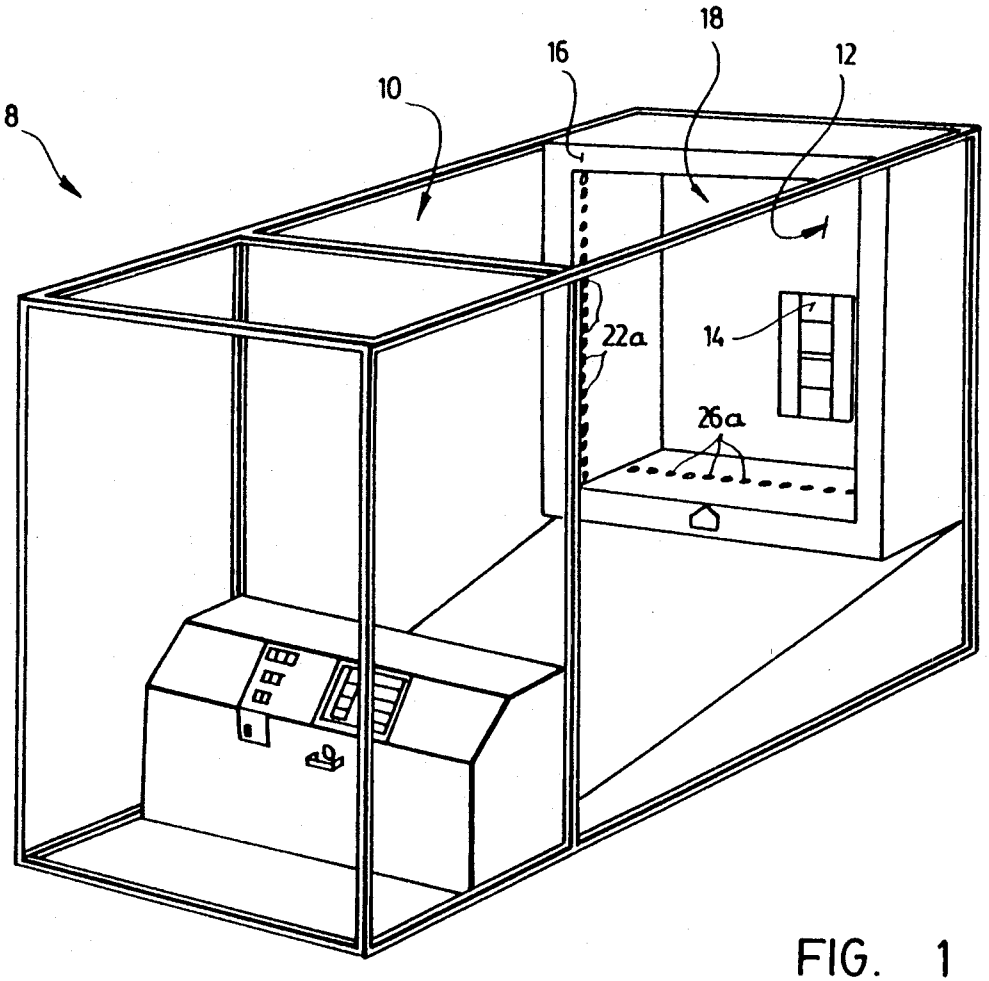
FIG. 1 is a perspective view of a training unit embodying the apparatus of the invention.

FIG. 1 shows a baseball training unit 8 that comprises a corridor 10 ending with a bottom wall 12 the centre of which is provided with a target zone 14 to indicate to the user where to aim for. A portion of the corridor 10 adjacent to the bottom wall 12 is provided with an enclosure 16 forming a chamber 18 open on the side facing the user and closed on other side by the bottom wall 12. This chamber 18 encloses two arrays of infrared emitters and two arrays of corresponding IR receivers, thereby forming a three dimensional system. Bascially, this system consist of a grid made up from horizontal light beams emitted from a the first array of emitters **22*a* aligned with corresponding receivers 22*b* (not shown). These light beams create a first plane of detection 20 (not shown) remote from the bottom wall 12. A second plane of detection 24 (not shown) is formed by the vertical light beams emitted by the emitters 26*a* of the second array closer to but distanced from the bottom wall 12 aligned with corresponding receivers 26*b* (not shown). The second plane 24 should be distanced from the wall 12** by at least the diameter of the ball.

Figure 2:
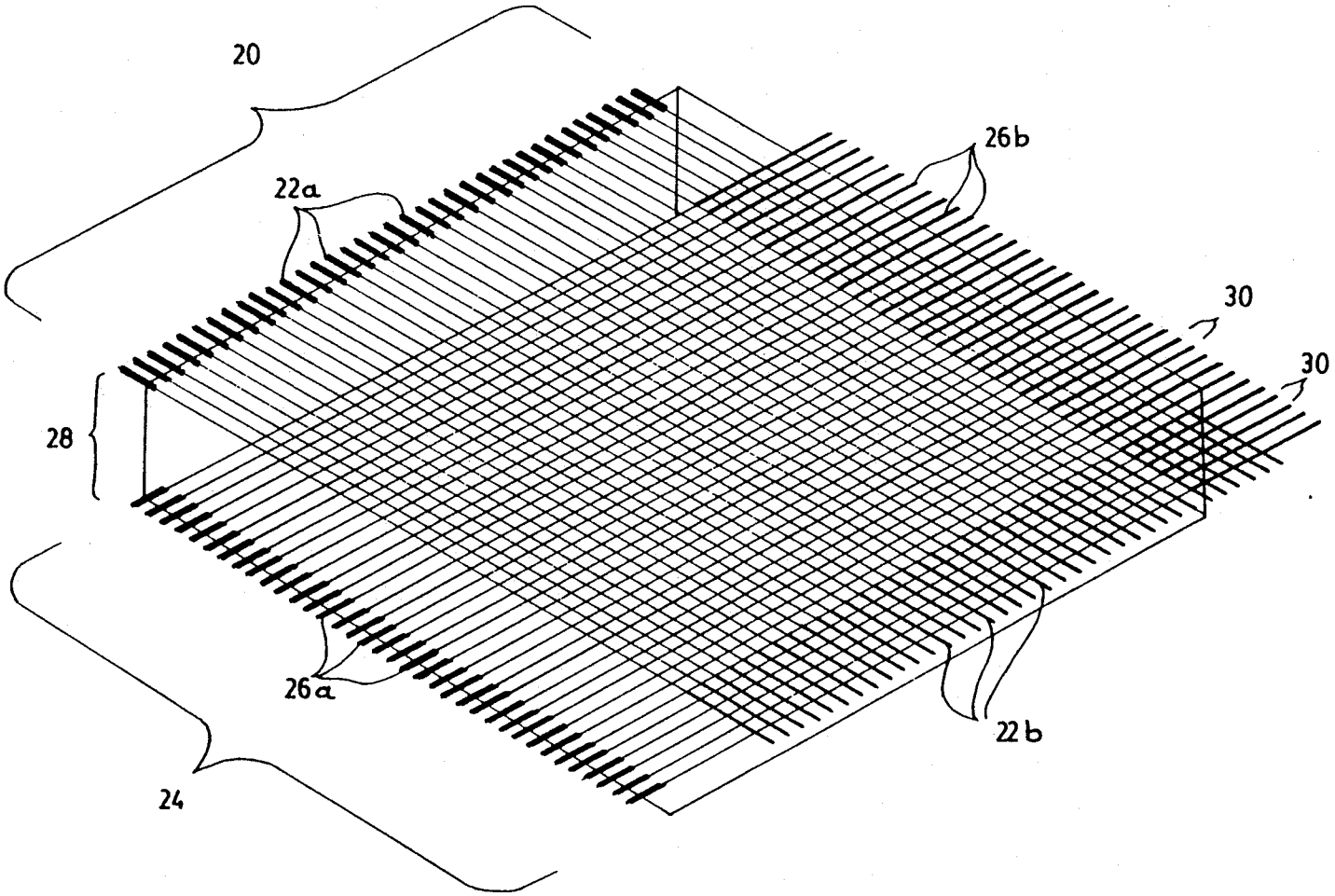
FIG. 2 is a perspective view of the three dimensional infrared grid according to the invention.

As shown in FIG. 2, if the light beams of the first plane 20 are vertical, the light beams of the second plane 24 are horizontal and vice versa. In any case both planes 20 and 24 must be parallel to each other and perpendicular to the trajectory of the ball. They should also be distanced from each other but the direction of their respective light beams should be perpendicular. Therefore, when a ball passes through the two planes, the position of the ball can be determined in terms of X and Y coordinates. Preferably, the distance 28 separating the two planes 20 and 24 is 12 inches.

Of course, the distance 30 separating each emitter or receiver from its neighbours on the same array can vary. Preferably, this distance 30 should be smaller than the diameter of a baseball. More preferably, the emitters and receivers should be separated from their neighbours by approximately 2 inches.

Figure 3:
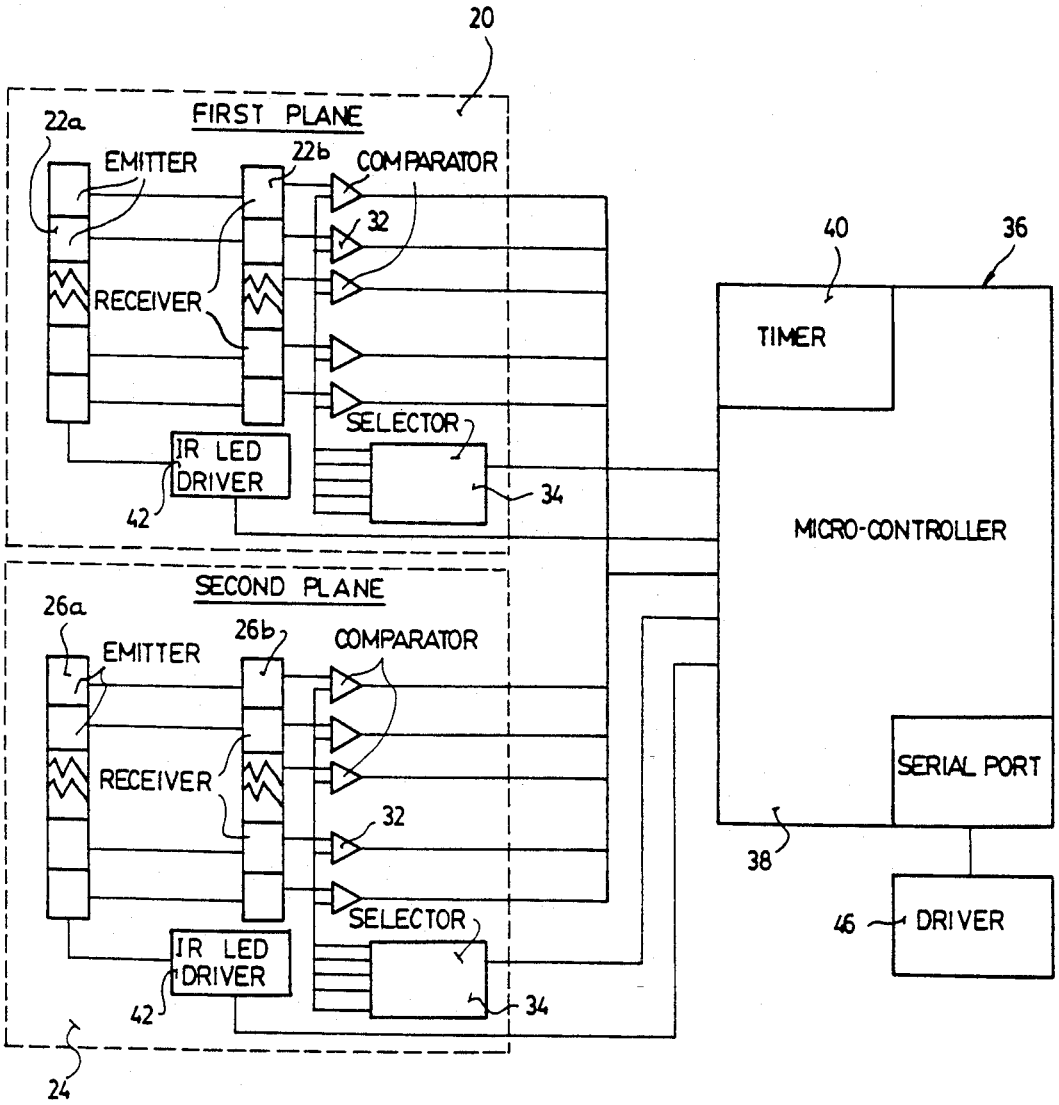
FIG. 3 is a block diagram of the relationship between the receivers, the interface unit and the processing means of the invention.

FIG. 3 shows the relationship between the emitters **22*a*, 26*a* and receivers 22*b*, 26*b*, the interface unit 32 and 34 and the processing means 36. The receivers 22*b* are grouped by sets of 8 (since the micro-controller 38 is a 8 bit controller) connected to a corresponding set of comparators 32 that interpret the signal in terms of "cut" or "uncut" signal, and amplify it. The interface unit comprises these sets of comparators 32 and also a selector 34 connected between the sets of comparators 32 and the processing means 36. The derived signals indicative of the position of the ball are generated by the set of comparators 32 and transmitted set by set to the micro-controller 38 that constitutes the main part of the processing means 36. The micro-controller 38** thereby determines the position of the ball by interpreting these derived signals.

The same steps are performed as the ball crosses the second plane 24. When the micro-controller 38 receives the signal, it records its time in relation with a precise timer 40 and records the position of the ball in X and Y coordinates in accordance with the derived signals that have been generated by the sets of comparators 32.

In this embodiment, the emitters 22*a* and 26*a* are infrared LEDs. Therefore an infrared LED driver 42 supplies the LED 22*a*, 26*a*, this driver being in turn activated / controlled by the micro-controller 38.

The speed of the ball is therefore calculated by the micro-controller 38 that is coupled to the interface unit 32 and 34. The micro-controller 38 takes the recorded times of entry and exit of the ball through the first 20 and second 24 planes, and carries out the following calculation:

$$\left[\frac{1}{[(t2 - t1) + (t4 - t3)]/2 + (t3 - t2)}\right] \times \text{constant} = \text{speed}$$

where $t1$ = time of entry in first plane 20

$t2$ = time of exit in first plane 20

$t3$ = time of entry in second plane 24

$t4$ = time of exit in second plane 24

$(t3 - t2)$ = time between the two planes.

The constant used to calculate the speed depends basically on the distance between the two planes. If the distance is 12 inches, a speed of 1 inch/msec will give a (t3−t2) of 12 msec. The inverse of the time 1/12 msec when multiplied by a predetermined factor 720 will give 60, a number that is approximately the speed of the ball when expressed in miles per hour (mph), therefore, for this distance the constant will be set at 720.

The time (t2−t1) and (t4−t3) are calculated in the formula to provide a correction factor when the full diameter of the ball (2¾ inches) passes between two infrared signals. Indeed, the emitters and receivers being spaced apart by 2 inches, it is possible that the cut in the IR signal takes place a fraction of a second after the ball has penetrated the plane. Therefore, measuring the time of duration of the cut in signal will be indicative of the portion of the ball that has cut the IR signal, and including them in the formula will permit that fact to be taken into consideration. The times of duration of the cut in the first plane and second planes are added together and divided by two to provide an averaged corrective factor.

Figure 4:
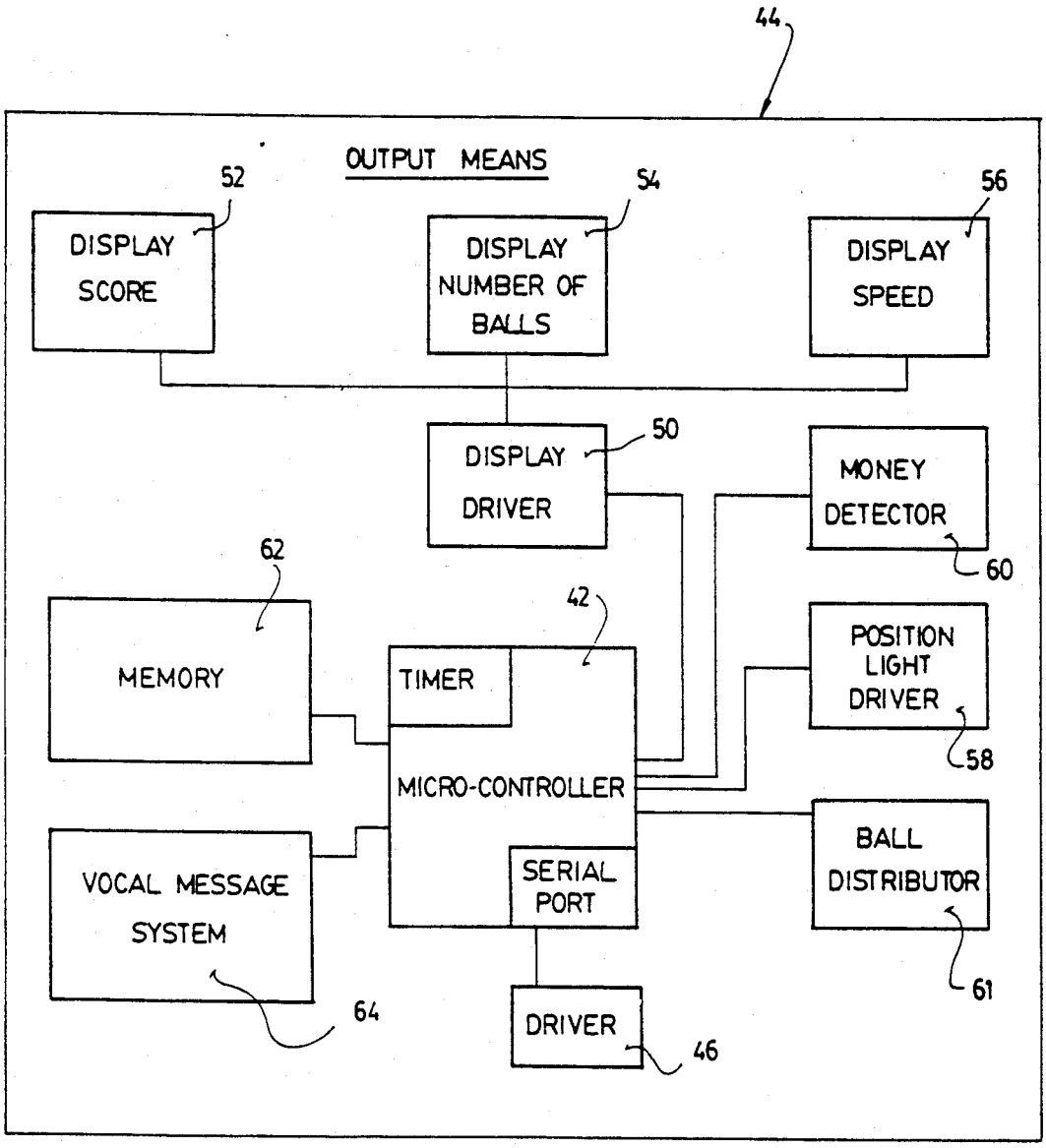
FIG. 4 is a block diagram of the different elements of the output means of the invention.
Figure 5:
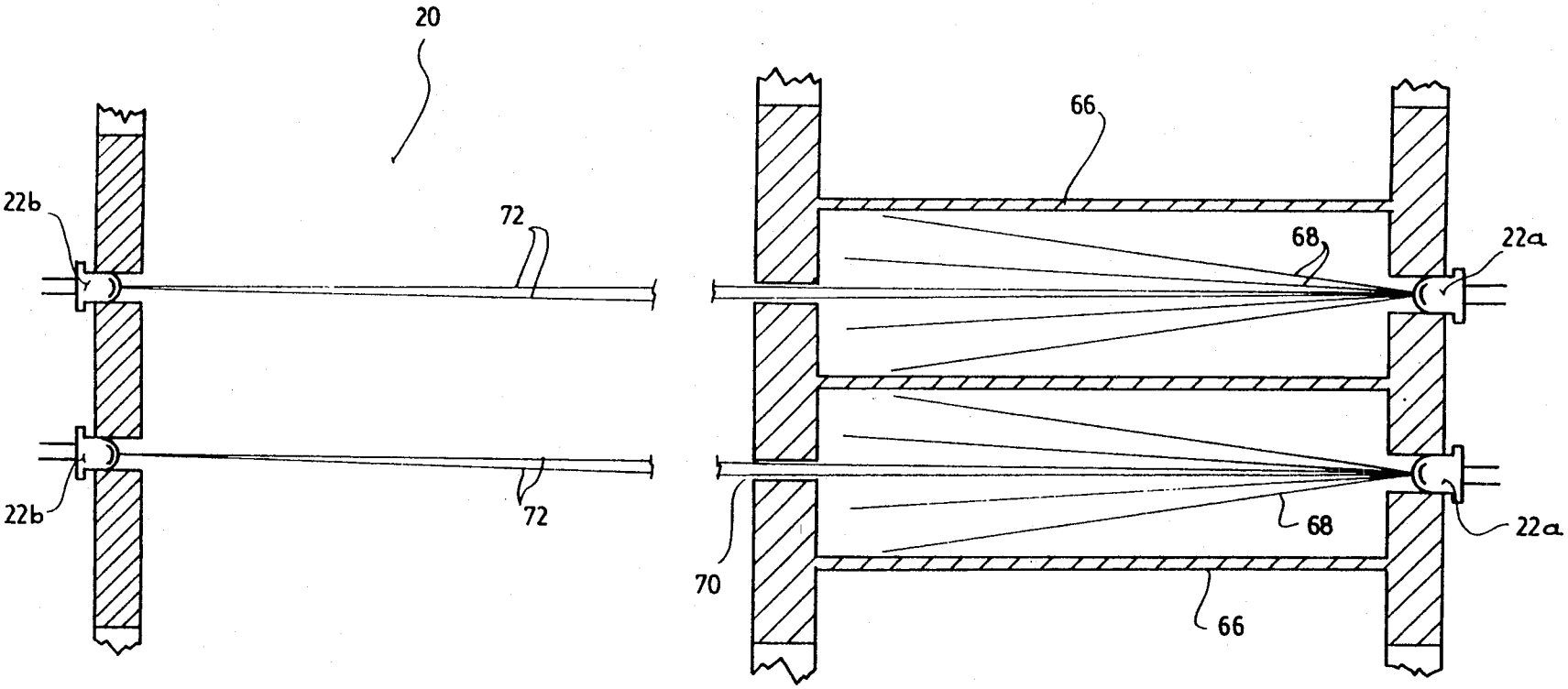
FIG. 5 is a cross-section view of the channel enclosing the emitters of the invention.

The micro-controller 38 is also connected to the micro-controller 42 of the output means 44 via a serial port driver 46. The output means 44 as illustrated on FIG. 4 comprise a micro-controller 42 that controls a display driver 50 driving different display boards for indicating the score 52, the number of balls played 54 and the speed of the last ball played 56. The micro-controller 42 also controls the lights 58 indicating the position of the ball i.e. the portion of the strike zone that has been hit by the ball by using the X and Y information determined by the micro-controller 38. As well, a money detector system 60, a system for distributing automatically the balls 61, a memory 62 and a vocal message 64 all connected to the micro-controller 42 may all be provided for an embodiment that can be placed in an arcade or the like.

FIG. 6 shows the emitters 22*a* of the invention enclosed in a channel 66 to eliminate the radially emitted signal 68 and ensure that a receiver 22*b* will receive only the signal emitted by its corresponding emitter 22*a* of the same pair. The channel 66 is terminated by a narrow opening 70 by which only the longitudinal signals 72 may pass and eventually reach the receiver 22*b*.

Of course, as will be readily understood by a person skilled in the art, the present apparatus may serve to evaluate other types of projectiles than a baseball. A hockey puck, a golf ball, a tennis ball, a football, etc. can all be monitored with such a device.

What is claimed is:

1. An apparatus for monitoring the position and speed of a projectile moving along a trajectory, said apparatus comprising:

(a) a three dimensional monitoring system comprising: a first array of infrared emitters each aligned with an infrared receiver for monitoring a first plane perpendicular to said trajectory, the emitters of said first array being positioned to emit parallel infrared light beams in a first direction and this form a first detecting grid extending in said first plane, the receivers of said first array receiving said light beams and having means for producing a first signal indicative of the position of the projectile within the first detecting grid when said projectile passes through said first plane; and a second array of infrared emitters each aligned with an infrared receiver for monitoring a second plane perpendicular to said trajectory and distanced from said first plane, the emitters of said second array being positioned to emit parallel infrared light beams in a second direction perpendicular to the first direction and this form a second detecting grid extending in said second plane; the receivers of said second array receiving said light beams and having means for producing a second signal indicative of the position of the projectile within the second detecting grid when said projectile passes through said second plane, (b) an interface unit for receiving said first and second signals from said receivers and generating derived signals;

(c) processing means receiving said derived signals from said interface unit for determining and recording the X and Y coordinates of said projectile within said first and second planes and for determining the speed of said projectile as a function of the times of entry and times of exit of said projectile in and out of both of said first and second detecting grids; and (d) output means for displaying the X and Y coordinates and the speed of said projectile;

said processing means being programmed to calculate the speed of the projectile by the following formula:

$$\left[\frac{1}{[(t2 - t1) + (t4 - t3)]/2 + (t3 - t2)}\right] \times \text{constant} = \text{speed}$$

wherein:

t1 is the time of entry of the projectile in the first detecting grid;

t2 is the time of exit of the projectile out of said first detecting grid;

t3 is the time of entry of the projectile in the second detecting grid; and t4 is the time of exit of the projectile out of said second detecting grid.

2. An apparatus according to claim 13, wherein said distance between the planes is approximately 12 inches.

3. An apparatus according to claim 1, wherein a distance of about 2 inches separates the emitters and receptors from one another.

4. An apparatus according to claim 1, wherein said emitters emit continuous infrared signals.

5. An apparatus according to claim 1, wherein said emitters and receivers are enclosed in a chamber for preventing interferences from external infrared signals.

6. An apparatus according to claim 1, wherein each of said infrared emitter is further enclosed in a channel for blocking radially emitted signals.

7. An apparatus according to claim 1, wherein said interface unit comprises sets of comparators operated one after the other by a selector for sequentially transmitting said signals.

8. An apparatus according to claim 7, wherein said processing means comprise a micro-controller for operating said selector and for receiving signals generated by said sets of comparators.

9. An apparatus according to claim 1, wherein said emitters emit continuous infrared signal, said emitters and receivers being enclosed in a chamber for preventing interferences from external infrared signals and said emitters being further enclosed in a channel for blocking radially emitted signals.

10. A method for monitoring position and speed of a projectile moving along a trajectory, said method comprising the steps of:

emitting first parallel light beams in a first direction perpendicular to said trajectory to form a first detecting grid extending in a first plane perpendicular to said trajectory;

emitting second parallel light beams in a second direction perpendicular to said trajectory and to said first direction to form a second detecting grid extending in a second plane perpendicular to said trajectory, said second plane being distanced from said first plane;

detecting which one of said first parallel light beams is cut when the projectile moves along said trajectory, said detection giving a first signal indicative of the position of the projectile within the first detecting grid when it passes through said first plane;

subsequently detecting which one of said second parallel light beams is cut when the projectile continues moving along said trajectory, said subsequent detection giving a second signal indicative of the position of the projectile within the second detecting grid when it passes through said second plane;

determining the X and Y coordinates of the projectile within said first and second planes, from said first and second signals; and determining the speed of said projectile also from said first and second signals;

said determination of the speed of the projectile comprises the steps of:

recording the time of entry t1 and the time of exit t2 of the projectile through said first detecting grid extending in said first plane;

recording the time of entry t3 and the time of exit t4 of the projectile through said second detecting grid extending in said second plane;

calculating the speed of said projectile by the following formula:

$$\left[\frac{1}{[(t2 - t1) + (t4 + t3)]/2 + (t3 - t2)}\right] \times \text{constant} = \text{speed.}$$

* * * * *